US007723919B2

(12) United States Patent
Saitoh et al.

(10) Patent No.: US 7,723,919 B2
(45) Date of Patent: May 25, 2010

(54) FRONT PANEL FOR PLASMA DISPLAY PANEL AND METHOD FOR PRODUCING THE SAME

(75) Inventors: Mitsuo Saitoh, Osaka (JP); Masashi Morita, Osaka (JP); Satoshi Maeshima, Hyogo (JP); Hideki Yamashita, Osaka (JP); Tsutomu Fujii, Osaka (JP); Nobuyuki Kamikihara, Nara (JP)

(73) Assignee: Panasonic Corporation, Osaka (JP)

( * ) Notice: Subject to any disclaimer, the term of this patent is extended or adjusted under 35 U.S.C. 154(b) by 244 days.

(21) Appl. No.: 12/125,673

(22) Filed: May 22, 2008

(65) Prior Publication Data

US 2008/0290800 A1 Nov. 27, 2008

(30) Foreign Application Priority Data

May 24, 2007 (JP) ..... 2007-137545

(51) Int. Cl.
*H01J 17/49* (2006.01)

(52) U.S. Cl. ..... 313/586; 313/587

(58) Field of Classification Search ..... 313/582, 313/586, 587, 473

See application file for complete search history.

(56) References Cited

U.S. PATENT DOCUMENTS 5,445,898 A * 8/1995 Budzilek et al. ..... 428/690

FOREIGN PATENT DOCUMENTS

| | | |
|---|---|---|
| JP | 2002-56773 | 2/2002 |
| JP | 2002-75173 | 3/2002 |
| JP | 2005-149743 | 6/2005 |
| JP | 2007-35655 | 2/2007 |

* cited by examiner

*Primary Examiner*—Vip Patel
(74) *Attorney, Agent, or Firm*—Wenderoth, Lind & Ponack, L.L.P.

(57) ABSTRACT

The present invention provides a front panel for a plasma display panel which can suppress the incidence of chipping of the barrier rib of a rear panel for a PDP, can enhance the stability of initial electron emission in a dielectric layer, and can reduce a voltage required for maintaining a wall charge. The front panel for a plasma display panel includes a substrate, a plurality of electrodes formed on the substrate, a dielectric layer formed to cover the respective electrodes and the substrate, a dielectric-protection layer formed to cover the dielectric layer, and powder components dispersed on the dielectric-protection layer, wherein an annealed layer having a thickness of 10 to 300 nm is formed on at least the exposed surface of each of the powder components, wherein said exposed surface does not contact the dielectric-protection layer.

14 Claims, 10 Drawing Sheets

*Fig. 2*
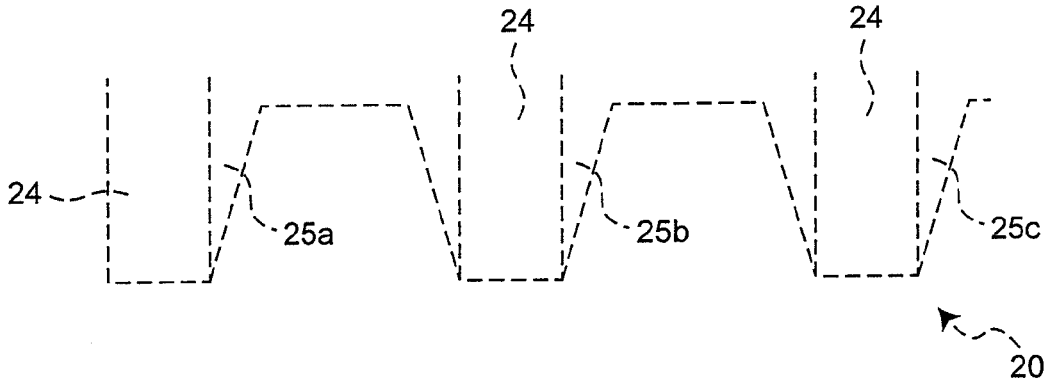
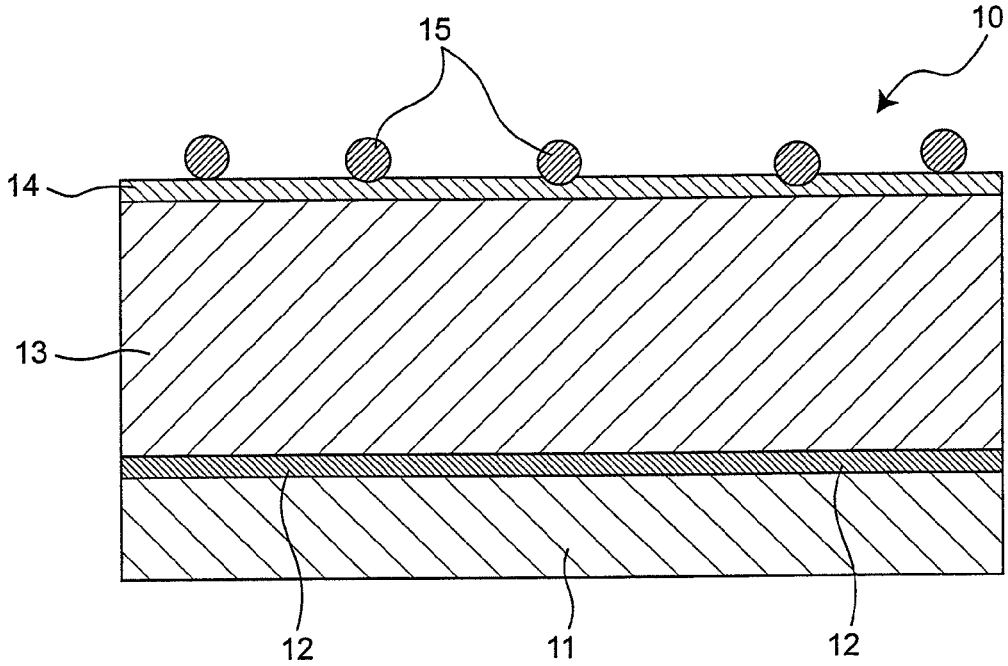

| PDP | PARTICLE DIAMETER | ANNEALED LAYER | INCIDENCE OF CHIPPING OF BARRIER RIB |
|---|---|---|---|
| FIRST CONVENTIONAL EXAMPLE | 5.0 μm | ABSENT | 20.3 % |
| SECOND CONVENTIONAL EXAMPLE | 2.0 μm | ABSENT | 1.8 % |
| FIRST EMBODIMENT | 2.0 μm | PRESENT | 2.3 % |

*Fig. 11*
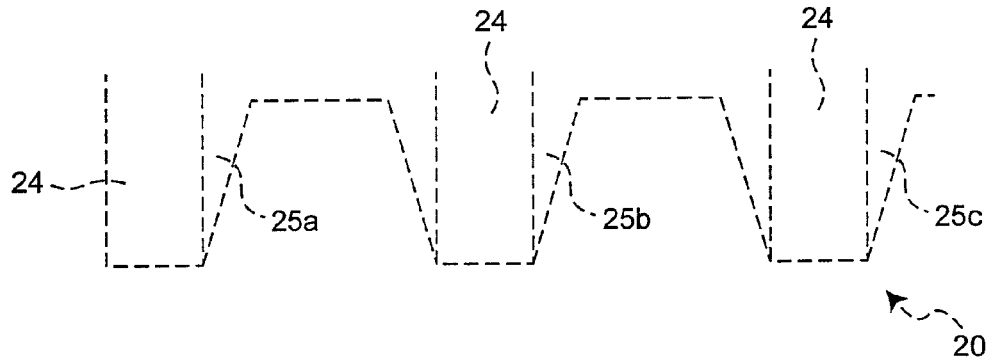
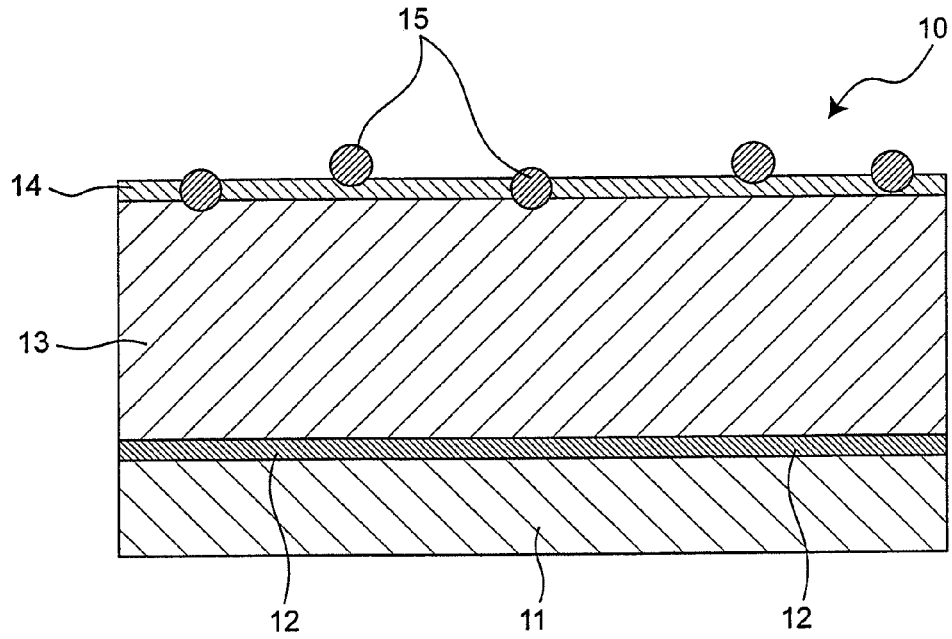

FRONT PANEL FOR PLASMA DISPLAY PANEL AND METHOD FOR PRODUCING THE SAME

BACKGROUND OF THE INVENTION

The present invention relates to a front panel for a plasma display panel including powder components and a method for producing the same, and a plasma display panel.

Hitherto, as a display device for displaying high-definition television images in a large screen, expectations for a display device using a plasma display panel (hereinafter, referred to as a PDP) have been heightening. Hereinafter, a constitution of a PDP of a conventional example will be described.

The PDP of a conventional example is provided with a front panel and a rear panel.

The front panel includes a front glass substrate, a plurality of display electrodes formed into stripe form on one surface of the front glass substrate, a dielectric glass layer covering these display electrodes and a dielectric-protection layer covering the dielectric glass layer.

The rear panel includes a rear glass substrate, a plurality of address electrodes formed into stripe form on one surface of the rear glass substrate and a dielectric glass layer covering these address electrodes. A plurality of barrier ribs are formed into stripe form on the dielectric glass layer. These barrier ribs are parallel to the address electrodes and located so that the address electrode is positioned between adjacent barrier ribs as seen from a thickness direction of the rear panel. A red, green, or blue phosphor layer is applied in turn to a bottom in a groove formed by two sides of the adjacent barrier ribs with the dielectric glass layer.

The PDP has a hermetically-closed structure in which the front panel (the side on which the dielectric-protection layer is formed) and the rear panel (the side on which the barrier ribs are formed) are opposed to each other and the periphery of a space between these two panels is sealed with a sealing member. In hermetically-closed spaces formed by this hermetically-closed structure, a discharge gas such as neon (Ne) or xenon (Xe) is filled to form discharge spaces. When a predetermined voltage is applied between the display electrodes and the address electrodes, a gas discharge is generated in the discharge spaces. The PDP can display color images by exciting the phosphor layer according to the ultraviolet rays generated through the gas discharge to emit visible light.

On the other hand, it is known that by dispersing the powder components composed of dielectrics on the dielectric-protection layer of the front panel, the stability of initial electron emission emitted from the dielectric glass layer can be enhanced (improved), and a voltage required for maintaining a wall charge of the dielectric glass layer can be decreased.

The powder component can be produced by the following procedure, for example.

First, a primary particle having an average particle diameter of about 0.2 to 3.0 μm is produced by heat-treating magnesium hydroxide (MgOH).

Next, the produced primary particle is further fired (heat-treated) in order to promote a reaction of unreacted magnesium hydroxide (MgOH) and eliminate residual substances.

The particle diameter is ultimately adjusted to an average particle diameter of about 4.0 to 6.0 μm by this firing.

The powder component thus produced has a single crystal structure, and therefore the inside and the surface of the powder component become the condition where very small lattice defects typified by a point defect and a dislocation exist.

An average particle diameter of the powder components can be adjusted to a proper size.

When a large average particle diameter of the powder components is desired, this can be realized, for example, by further heat-treating the fired powder components. Thereby, the average particle diameter of the powder components can be set at a particle diameter of about several tens of micrometers to several hundreds of micrometers.

Further, when a small average particle diameter is desired, this can be realized, for example, by pulverizing the fired powder component with an Ultimizer. Thereby, the average particle diameter of the powder components can be adjusted to a level equal to that of the primary particle, or a size of about 0.2 to 3.0 μm.

Examples of PDPs of conventional examples, containing powder components, include a PDP disclosed in Patent Document 1 (i.e., Japanese Unexamined Patent Publication No. 2005-149743). In Patent Document 1, an alternating current (AC) PDP including a particle size distribution in which a grain size of the powder component is 5.0 μm or less is disclosed.

SUMMARY OF THE INVENTION

In the PDP of a conventional example, generally, the front panel and the rear panel are located with a gap of about 10 to 30 μm provided between the dielectric-protection layer of the front panel and the top of the barrier rib of the rear panel. If an average particle diameter of the powder components is set at about 5.0 μm at this time, a particle having a large particle diameter within the range of the particle size distribution, or a plurality of particles piled up may come into physical contact with the barrier rib. Therefore, the barrier rib becomes apt to chip and there is an issue that the production yield of the PDP is reduced.

As a method for solving this issue, it is conceivable that the average particle diameter of the powder components is reduced to a level of the primary particle, e.g., about 2.0 μm. However, in the case where the average particle diameter of the powder components is set at about 2.0 μm, there are other issues that the stability of initial electron emission becomes low (poor) and the voltage required for maintaining a wall charge becomes large compared with the case where the average particle diameter is set at about 5.0 μm.

That is, yield improvements are traded off for enhancing the stability of initial electron emission and reducing a voltage required for maintaining a wall charge.

Therefore, it is an object of the present invention to solve the foregoing conventional issues and to provide a front panel for a PDP, a method for producing the front panel for a PDP, and a PDP provided with the front panel for a PDP, which can suppress the incidence of chipping of the barrier rib of the rear panel for a PDP, can enhance the stability of initial electron emission in the dielectric layer, and can reduce a voltage required for maintaining a wall charge.

In order to achieve the above-mentioned object, the present invention is constituted as follows.

According to a first aspect of the present invention, there is provided a front panel for a plasma display panel comprising:

a substrate, a plurality of electrodes formed on the substrate, a dielectric layer formed to cover the respective electrodes and the substrate, a dielectric-protection layer formed to cover the dielectric layer, and powder components dispersed on the dielectric-protection layer, wherein an annealed layer having a thickness of 10 to 300 nm is formed on at least an exposed surface of each of the powder components, wherein said exposed surface does not contact the dielectric-protection layer.

According to a second aspect of the present invention, there is provided the front panel for a plasma display panel as defined in the first aspect, wherein the annealed layer is a thickness of 10 to 100 nm.

According to a third aspect of the present invention, there is provided the front panel for a plasma display panel as defined in the first aspect, wherein the annealed layer is formed on an entire surface of the powder component.

According to a forth aspect of the present invention, there is provided the front panel for a plasma display panel as defined in the first aspect, wherein the powder component emits light by cathode-luminescence having a peak in a wavelength region of 200 to 300 nm by irradiation of an electron beam, and wherein light by cathode-luminescence emitted from the annealed layer has higher luminous intensity than light by cathode-luminescence emitted from an inner layer adjacent to the annealed layer on an inside of the annealed layer.

According to a fifth aspect of the present invention, there is provided the front panel for a plasma display panel as defined in the first aspect, wherein the powder component emits light by cathode-luminescence having a peak in a wavelength region of 200 to 300 nm by irradiation of an electron beam, and wherein light by cathode-luminescence emitted from a top portion of the powder component has higher luminous intensity than light by cathode-luminescence emitted from a bottom portion of the powder component, wherein said top portion does not contact the dielectric-protection layer and said bottom portion contacts the dielectric-protection layer.

According to a sixth aspect of the present invention, there is provided the front panel for a plasma display panel as defined in the first aspect, wherein an average particle diameter of the powder components is 3.0 μm or less.

According to a seventh aspect of the present invention, there is provided the front panel for a plasma display panel as defined in the first aspect, wherein an average particle diameter of the powder components is 0.2 μm or more.

According to an eighth aspect of the present invention, there is provided the front panel for a plasma display panel as defined in the first aspect, wherein a base material of the powder component has a single crystal structure.

According to a ninth aspect of the present invention, there is provided the front panel for a plasma display panel as defined in the first aspect, wherein the dielectric layer includes at least one of magnesium oxide, calcium oxide, strontium oxide, and barium oxide.

According to a 10th aspect of the present invention, there is provided the front panel for a plasma display panel as defined in the first aspect, wherein the powder component includes at least one of magnesium oxide, calcium oxide, strontium oxide, and barium oxide.

According to a 11th aspect of the present invention, there is provided a plasma display panel having the front panel for a plasma display panel as defined in any one of the first aspect to 10th aspect.

According to 12th aspect of the present invention, there is provided a method for producing a front panel for a plasma display panel, comprising:

forming a plurality of electrodes on a substrate, forming a dielectric layer to cover the respective electrodes and the substrate, forming a dielectric-protection layer to cover the dielectric layer, and dispersing powder components on the dielectric-protection layer and then irradiating an energy wave to the exposed surface of each of the powder components to form an annealed layer having a thickness of 10 to 300 nm.

According to 13th aspect of the present invention, there is provided a method for producing a front panel for a plasma display panel as defined in 12th aspect, comprising, in place of dispersing the powder components on the dielectric-protection layer and then forming the annealed layer on the exposed surface of each of the powder components, irradiating an energy wave to an entire surface of each of the powder components to form the annealed layer having a thickness of 10 to 300 nm and then dispersing the powder components on the dielectric-protection layer.

According to 14th aspect of the present invention, there is provided the method for producing a front panel for a plasma display panel as defined in 12th aspect, wherein annealing of the surface of each of the powder components is performed by any one of flash lamp annealing, laser annealing, and rapid thermal annealing.

In the front panel for a plasma display panel of the present invention, the annealed layer is formed on at least the exposed surface of each of the powder components, which does not contact the dielectric-protection layer. Thereby, it is possible to provide a front panel for a plasma display panel which can suppress the incidence of chipping of the barrier rib of the rear panel for a plasma display panel, can enhance the stability of initial electron emission in the dielectric layer, and can reduce a voltage required for maintaining a wall charge.

In accordance with the method for producing a front panel for a plasma display panel of the present invention, after the powder components are dispersed on the dielectric-protection layer, an energy wave is irradiated to the exposed surface of each of the powder components to form the annealed layer. Thereby, it is possible to provide a method for producing a front panel for a plasma display panel which can suppress the incidence of chipping of the barrier rib of the rear panel for a plasma display panel, can enhance the stability of initial electron emission in the dielectric layer, and can reduce a voltage required for maintaining a wall charge.

It is also possible to have effects similar to those described above, in place of the above-mentioned procedure, by dispersing the powder components on the dielectric-protection layer after irradiating an energy wave to the entire surface of each of the powder components to form the annealed layer.

In the plasma display panel of the present invention, since this plasma display panel is provided with the front panel for a plasma display panel, it is possible to provide a plasma display panel which can suppress the incidence of chipping of the barrier rib of the rear panel for a plasma display panel, can enhance the stability of initial electron emission in the dielectric layer, and can reduce a voltage required for maintaining a wall charge.

BRIEF DESCRIPTION OF THE DRAWINGS

These and other aspects and features of the present invention will become clear from the following description taken in conjunction with the preferred embodiments thereof with reference to the accompanying drawings, in which:

FIG. 2 is a partially enlarged sectional view schematically showing a constitution of a front panel of the plasma display panel according to the first embodiment of the present invention;

FIG. 10 is a partially enlarged sectional view showing a constitution of the powder component of the plasma display panel according to the second embodiment of the present invention; and FIG. 11 is a partially enlarged sectional view schematically showing another formation example of the powder components.

DETAILED DESCRIPTION OF THE PREFERRED EMBODIMENTS

Figure 1:
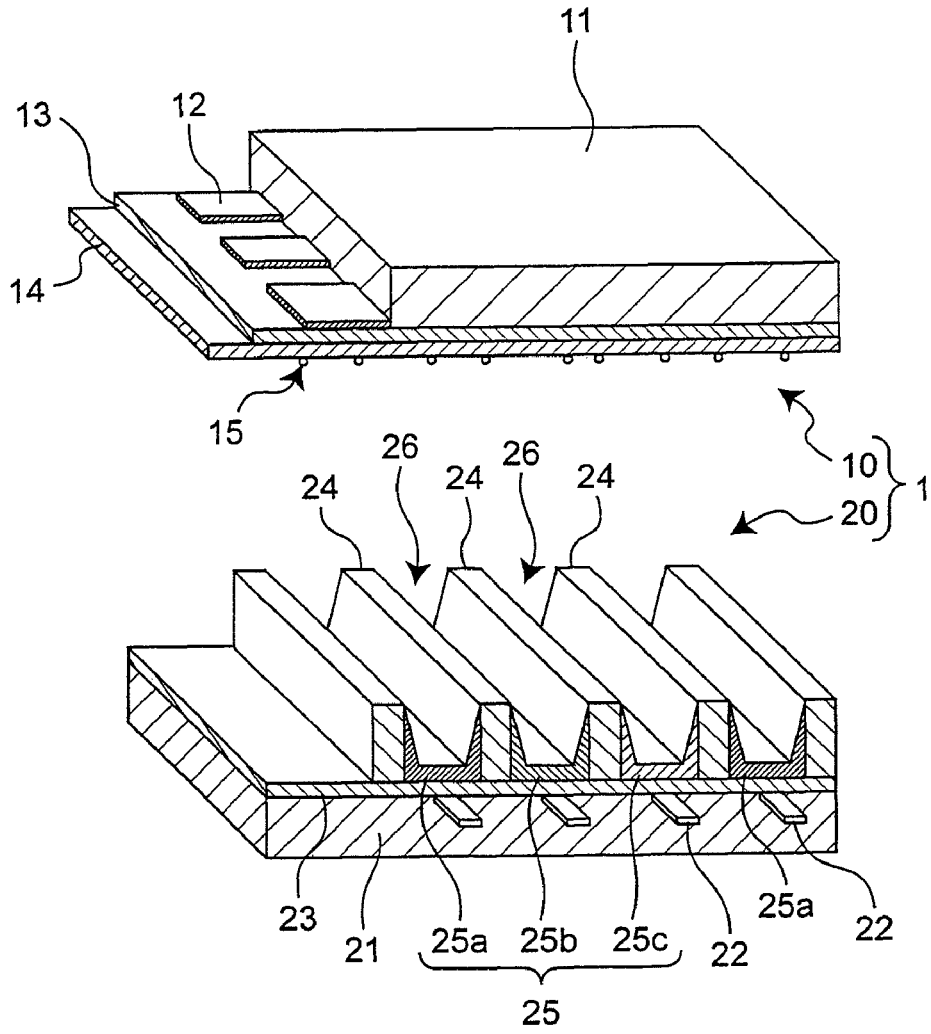
FIG. 1 is a perspective view schematically showing a constitution of a plasma display panel according to a first embodiment of the present invention.

Before the description of the present invention proceeds, it is to be noted that like parts are designated by like reference numerals throughout the accompanying drawings.

Hereinafter, preferred embodiments of the present invention will be described by reference to drawings.

First Embodiment

Figure 3:
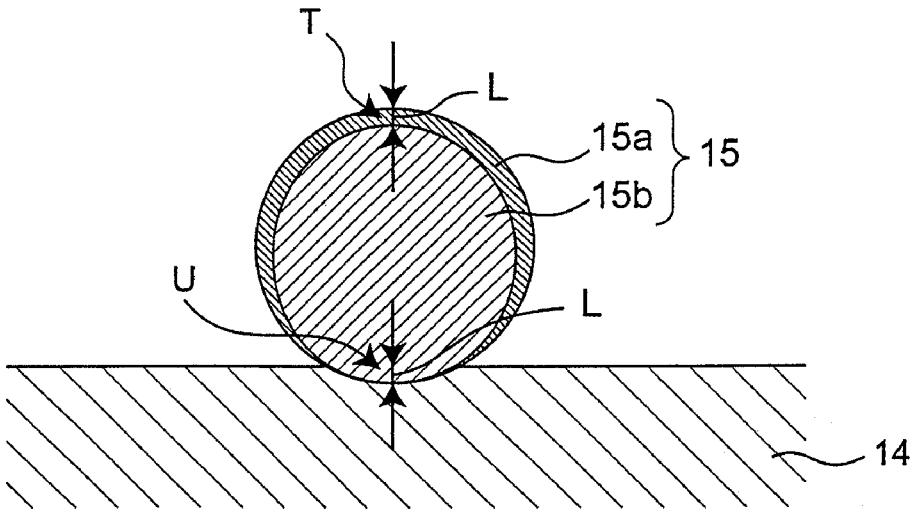
FIG. 3 is a partially enlarged sectional view of FIG. 2.

A constitution of a PDP of a first embodiment of the present invention will be described referring to FIGS. 1 to 3.

FIG. 1 is a perspective view schematically showing a basic constitution of a PDP 1 according to the first embodiment of the present invention. Further, in FIG. 1, a front panel 10 and a rear panel (back panel) 20 of the PDP 1 are illustrated away from each other for ease of reference. FIG. 2 is a partially enlarged sectional view of the front panel 10. In FIG. 2, the arrangement of the front panel 10 is vertically opposite in direction to that of the front panel 10 in FIG. 1. FIG. 3 is a partially enlarged sectional view of FIG. 2.

In FIG. 1, the PDP 1 includes a front panel 10 for a PDP (hereinafter, referred to as a front panel) and a rear panel 20 for a PDP (hereinafter, referred to as a rear panel) opposed to the front panel 10. A sealing member (not shown) such as glass frit is located on the periphery of a space between the front panel 10 and the rear panel 20. By the sealing member, the PDP 1 is sealed in an airtight manner and discharge spaces are formed in the inside of the PDP 1. In the discharge spaces, a discharge gas such as neon (Ne) or xenon (Xe) is filled. Filling of the discharge gas is performed while reducing the pressure of the discharge spaces to a lower pressure than the atmospheric pressure.

The front panel 10 includes a front glass substrate 11 made of sodium borosilicate glass or lead glass. The front glass substrate 11 is formed into flat panel form by a float process. A plurality of strip-shaped display electrodes 12, which are an example of an electrode, are placed in parallel to each other (formed into stripe form) on one surface of the front glass substrate 11. The display electrode 12 is made from, for example, silver (Ag) or chromium-copper-chromium (Cr—Cu—Cr).

Further, a dielectric glass layer 13, which is an example of a dielectric layer, is formed on one surface of the front glass substrate 11 so as to cover the respective display electrodes 12. The dielectric glass layer 13 is formed by use of glass powders having a particle diameter of about 0.1 to 20.0 μm and acts as a capacitor. A dielectric-protection layer 14 is formed on the dielectric glass layer 13 so as to cover the dielectric glass layer 13. The dielectric-protection layer 14 is made of, for example, magnesium oxide (MgO). Powder components 15 made of a dielectric is (preferably uniformly) dispersed on the dielectric-protection layer 14 as shown in FIG. 2. As shown in FIG. 3, each of the powder components 15 includes an annealed layer 15*a* formed in a thickness of 10 to 100 nm on the exposed surface which does not contact the dielectric-protection layer 14 and an inner layer 15*b* adjacent to the annealed layer 15*a* on the inside of the annealed layer 15*a* (on the central side). The annealed layer 15*a* will be described in detail later.

The rear panel 20 includes a rear glass substrate 21 configured in the same manner as in the front glass substrate 11. A plurality of strip-shaped address electrodes 22 are placed in parallel to each other on one surface of the rear glass substrate 21. The address electrode 22 is made from, for example, indium tin oxide (ITO) and silver (Ag) or chromium-copper-chromium (Cr—Cu—Cr).

A dielectric glass layer 23 is formed on one surface of the rear glass substrate 21 so as to cover the respective address electrodes 22. A plurality of barrier ribs (partition walls) 24 are formed in stripe form on the dielectric glass layer 23. These barrier ribs 24 are parallel to the address electrodes 22 and located so that the address electrode 22 is positioned between adjacent barrier ribs 24 as seen from a thickness direction of the rear panel 20. Thereby, the barrier ribs 24 partitions the discharge spaces for every address electrode 22.

A phosphor layer (fluorescence layer) 25 is applied to a bottom in a groove 26 formed by two sides of the adjacent barrier ribs 24 with the dielectric glass layer 23. The phosphor layer 25 includes a red phosphor layer 25*a*, a green phosphor layer 25*b*, and a blue phosphor layer 25*c*. These phosphor layers are formed in turn in a direction orthogonal to the address electrodes 22.

The PDP 1 thus configured can display color images by applying a predetermined voltage between the display electrodes 12 and the address electrodes 22 to generate a gas discharge in the discharge space, and exciting the phosphor layer 25 by ultraviolet rays generated through the gas discharge to emit visible light.

Figure 4:
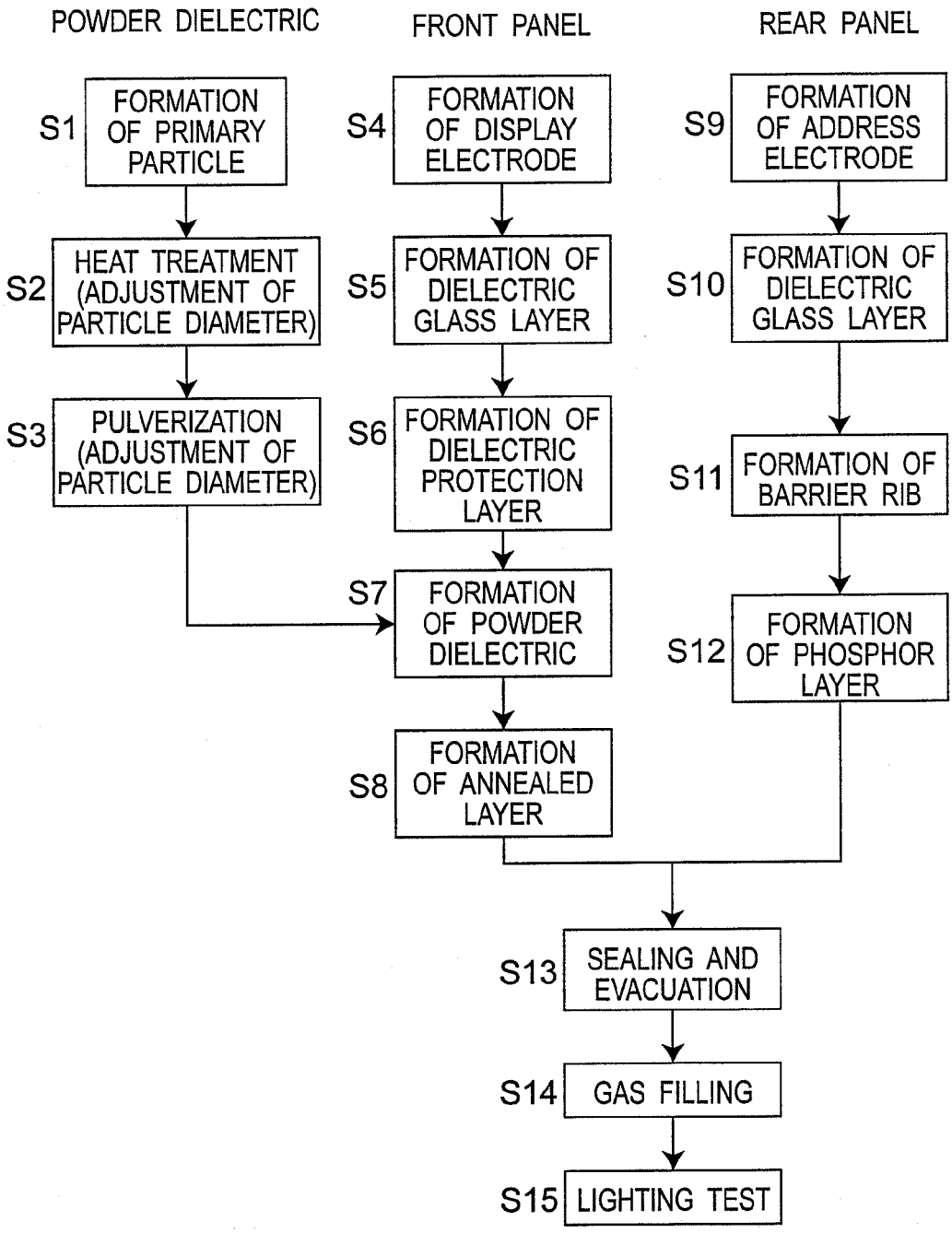
FIG. 4 is a flow chart showing a method for producing the plasma display panel according to the first embodiment of the present invention.

Next, referring to FIGS. 1 to 4, a method for producing the PDP 1 according to the first embodiment of the present invention will be described. FIG. 4 is a flow chart showing a method for producing the PDP 1. Herein, the production method will be described exemplifying materials and dimensions of the respective members in order to facilitate the understanding of the present invention, however, the present invention is not limited to this.

First, a method for producing the powder components 15 will be described. The powder components 15 can be produced by performing the following steps S1 to S3.

In step S1, a primary particle having an average particle diameter of about 0.2 to 3.0 μm is produced by heat-treating magnesium hydroxide (MgOH).

In step S2, the produced primary particle is further fired (heat-treated) in order to promote a reaction of unreacted magnesium hydroxide (MgOH) and eliminate residual substances. The particle diameter is adjusted to an average particle diameter of about 4.0 to 6.0 μm by this firing.

In step S3, the fired powder components 15 are pulverized to adjust the particle diameter to an average particle diameter of about 2.0 μm.

Thereby, the production of the powder components 15 is completed.

Next, a method for producing the front panel 10 will be described. The front panel 10 can be produced by performing the following steps S4 to S8.

In step S4, a plurality of display electrodes 12 are formed into stripe form on the front glass substrate 11.

In step S5, a dielectric glass layer 13 is formed so as to cover the respective display electrodes 12 and the front glass substrate 11.

In step S6, a dielectric-protection layer 14 is formed so as to cover the dielectric glass layer 13 using a vacuum deposition process. At this time, a thickness of the dielectric-protection layer 14 is set at, for example, about 0.5 to 1.5 μm.

In step S7, a mixed paste of organic substances and the powder components 15 is applied onto the dielectric-protection layer 14 using a screen printing method, and thereafter the paste is dried and fired to disperse the powder components 15 on the dielectric-protection layer 14.

At this time, the mixed paste of the organic substances and the powder components 15 to be used is a paste in which for example, the concentration of each of the powder components 15 is generally 0.1 to 20.0% by weight.

In step S8, an energy wave is irradiated to the exposed surface of each of the powder components 15 dispersed on the dielectric-protection layer 14 to form an annealed layer 15*a* (refer to FIG. 3) (surface annealing is applied).

Thereby, the production of the front panel 10 is completed.

Figure 5:
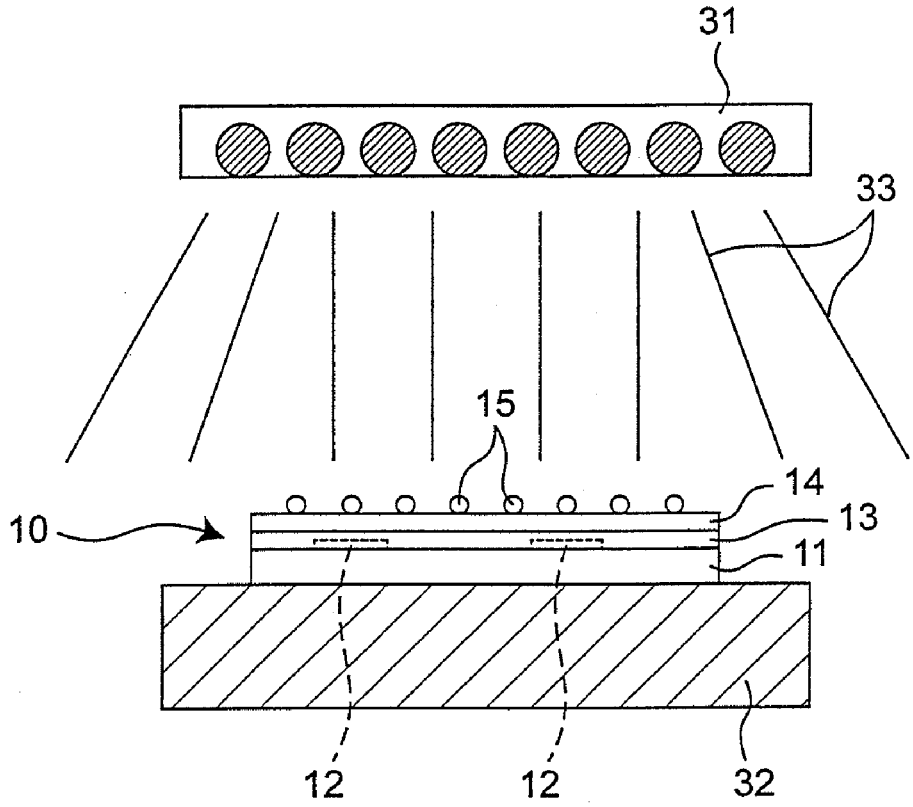
FIG. 5 is a view schematically showing the state of forming an annealed layer on the exposed surface of each of powder components of the plasma display panel according to the first embodiment of the present invention.

Examples of the method for forming the annealed layer 15*a* on the exposed surface of each of the powder components 15 include a flash lamp annealing method (hereinafter, referred to as an FLA method) in which a xenon lamp 31 is used as shown in FIG. 5. An example of the formation method of the annealed layer 15*a*, in which this FLA method is used, will be described in the following referring to FIG. 5.

First, the front panel 1 is placed on a heater 32 for a substrate with the front glass substrate 11 facing down.

Next, the heater 32 for a substrate is heated and the temperature of the front glass substrate 11 is raised generally to about 300 to 500° C., and pulsed light 33 of the order of ms (millisecond) is irradiated to the powder components 15 with the xenon lamp 31 located above the front panel 1. At this time, the pulse width of the irradiated pulsed light 33 is set at 0.8 to 3.0 ms and its power density is set at 10 to 40 mJ/cm$^2$.

Thereby, the annealed layer 15*a* (refer to FIG. 3) can be formed on the exposed surface of each of the powder components 15.

In addition, from the foregoing FLA method, it can be estimated that the surface temperature of the front glass substrate 11 is 1400° C. or higher since the temperature at which the surface of a high purity silicon substrate is melted is about 1400° C. From findings of heretofore known technology of doping a silicon (Si) semiconductor with impurities, it is known that the depth, to which the heat energy reaches when the surface temperature of the front glass substrate 11 reaches 1000° C. or higher, is generally about several nanometers to 100 nm. Therefore, the annealed layer 15*a* is formed in a thickness of about 10 to 100 nm on the exposed surface of each of the powder components 15.

Next, a method for producing the rear panel 20 will be described. The rear panel 20 can be produced by performing the following steps S9 to S12.

In step S9, a plurality of address electrodes 22 are formed into stripe form on the rear glass substrate 21.

In step S10, a dielectric glass layer 23 is formed so as to cover the respective address electrodes 22.

In step S11, a plurality of barrier ribs 24 are formed into stripe form on the dielectric glass layer 23. These barrier ribs 24 are parallel to the address electrode 22 and located so that the address electrode 22 is positioned between adjacent barrier ribs 24 as seen from a thickness direction of the rear panel 20.

In step S12, a red phosphor layer 25*a*, a green phosphor layer 25*b*, and a blue phosphor layer 25*c* are applied in turn to a bottom in a groove 26 formed by two sides of the adjacent barrier ribs 24 with the dielectric glass layer 23.

Thereby, the production of the rear panel 20 is completed.

In addition, the order of production of the front panel 10 and the rear panel 20 is indifferent. That is, the front panel 10 and the rear panel 20 may be produced simultaneously, or may be produced in turn in any order.

Next, a method for producing the PDP 1 by use of the front panel 10 and the rear panel 20 thus produced will be described. The PDP 1 can be produced by performing the following steps S13 to S15.

In step S13, the front panel 10 and the rear panel 20 are opposed to each other so that the powder components 15 are opposed to the barrier ribs 24, and the periphery of these two panels is sealed with a sealing member (not shown) to form a hermetically-closed space, and air within the formed hermetically-closed space is evacuated to reduce the pressure of the space.

In step S14, the depressurized hermetically-closed space is filled with a discharge gas such as neon (Ne) or xenon (Xe) to form discharge spaces.

In step S15, a lighting test is performed to observe whether the PDP is illuminated or not by application of a predetermined voltage to the discharge spaces.

Thereby, the production of the PDP 1 is completed.

Next, the results of performing a comparison between the panel characteristic of the PDP 1 according to the first embodiment of the present invention and the panel characteristics of the PDPs of first and second conventional examples will be described referring to FIGS. 6 and 7. Here, a PDP containing the powder components in which the annealed layer 15*a* is not formed and an average particle diameter of the powder is set at 5.0 μm is considered as a PDP of the first conventional example. A PDP containing the powder components in which the annealed layer 15*a* is not formed and an average particle diameter of the powder is set at 2.0 μm is considered as a PDP of the second conventional example. Here, the PDP of the first conventional example, the PDP of the second conventional example and the PDP 1 according to the first embodiment of the present invention are set at the same rate of the dielectric-protection layer to be covered with the powder components.

Figures 6, 7:
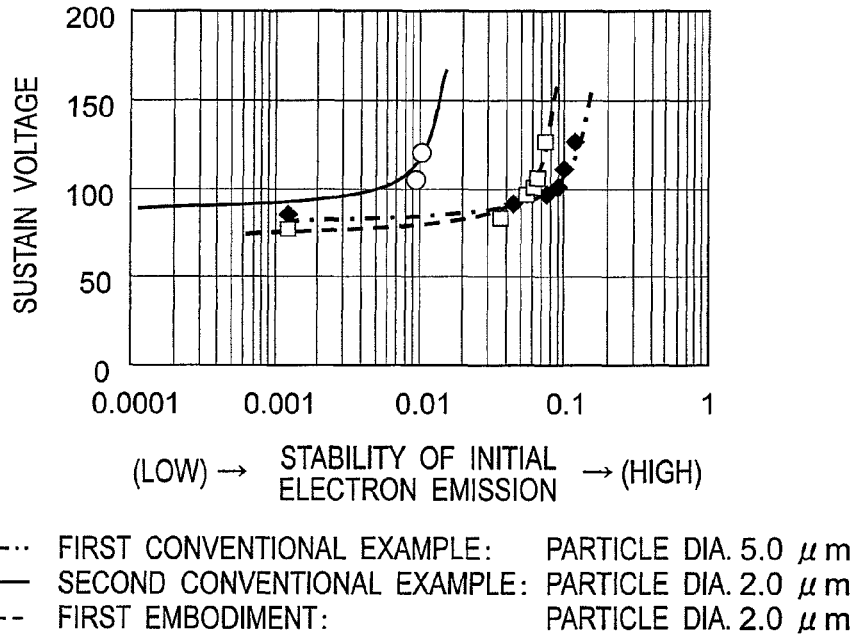
FIG. 6 is graph showing panel characteristics of plasma displays according to a first conventional example, a second conventional example, and the first embodiment of the present invention.
FIG. 7 is a table showing the incidences of chipping of a barrier rib of plasma display panels according to the first conventional example, the second conventional example, and the first embodiment of the present invention.

FIG. 6 is graph of comparing panel characteristics between the PDP of the first conventional example, the PDP of the second conventional example, and the PDP 1 according to the first embodiment of the present invention. Here, a PDP, in which the stability of initial electron emission in the dielectric glass layer 13 is higher and a voltage required for maintaining a wall charge is smaller, is a PDP having a better panel characteristic. That is, in FIG. 6, a PDP in which the curve of the graph is positioned in the lower right is a PDP having a better panel characteristic. FIG. 7 is a table providing a summary of the incidence of chipping of the barrier rib in the PDP of the first conventional example, the PDP of the second conventional example, and the PDP 1 according to the first embodiment of the present invention.

As is apparent from FIGS. 6 and 7, in the PDP of the second conventional example in which an average particle diameter of the powder components is set at 2.0 μm, the incidence of chipping of the barrier rib can be reduced (20.3%→1.8%) compared with the PDP of the first conventional example in which an average particle diameter of the powder components is set at 5.0 μm, however, the panel characteristic is deteriorated (the stability of initial electron emission becomes low and a voltage required for maintaining a wall charge becomes large). On the other hand, in the PDP 1 (e.g., PDP 1 in which an average particle diameter of the powder components is set at 2.0 μm and annealing is applied to the surface) of the first embodiment of the present invention, the incidence of chipping of the barrier rib can be reduced (20.3%→2.3%) while maintaining the panel characteristic good compared with the PDP of the first conventional example.

Next, the PDP of the first conventional example, the PDP of the second conventional example, and the PDP 1 according to the first embodiment of the present invention, respectively, are cut away, and the luminous intensity of light by cathode-luminescence (hereinafter, referred to as light by CL) at a cross-section of each powder component 15 cut away was measured using a cathode-luminescence method (hereinafter, referred to as a CL method). The results of measurements will be described referring to FIG. 3. Herein, the luminous intensity of light by CL was measured in a measuring region near the top portion (hereinafter, referred to as a top portion T) and in a measuring region near the bottom portion (hereinafter, referred to as a bottom portion U) of the powder component 15. That is, the luminous intensity of light by CL was measured in the top portion T where the annealed layer 15*a* is formed and the bottom portion U where the annealed layer 15*a* is not formed. Further, the light by CL of the powder component 15 has a peak in a wavelength region of 200 to 300 nm. Herein, the light by CL has a peak near a wavelength of 240 nm.

Further, a depth L below the surface of the powder component 15 of each measuring region is generally set at 10 to 100 nm to substantially correspond to the thickness of the annealed layer 15*a*. Herein, measurements at about ten points were performed in each measuring region. More specifically, three to four locations (for example, depths of 10 nm, 40 nm, 70 nm, and 100 nm) were selected every about 30 nm along a direction of depth from the surface of the powder component 15 and about three points per one location, totally about ten points, were measured. Also in the PDPs of the first and the second conventional examples, the luminous intensity of light by cathode-luminescence was similarly measured in top portions Tp1, Tp2 and bottom portions Up1, Up2 of the respective powder components.

As the results of the foregoing measurements, the average luminous intensity in the top portion Tp1 of the powder component (average particle diameter 5.0 μm) of the PDP of the first conventional example was substantially equal to that in the bottom portion Up1. Therefore, when the average luminous intensity in the top portion Tp1 and the average luminous intensity in the bottom portion Up1 were taken as 1.00, respectively, the luminous intensity in the top portion Tp2 and the luminous intensity in the bottom portion Up2 of the powder component (average particle diameter 2.0 μm) of the PDP of the second conventional example were respectively 0.35 to 0.60 in general.

On the other hand, the luminous intensity of the top portion T of the powder component 15 of the PDP 1 according to the first embodiment of the present invention was generally distributed within a range of 0.80 to 1.20 and the luminous intensity of the bottom portion U was generally distributed within a range of 0.50 to 0.65. That is, the top portion T of the powder component 15 of the PDP 1 according to the first embodiment of the present invention exhibited a luminous intensity almost equal to that of the top portion Tp1 of the powder component of the PDP of the first conventional example, and the bottom portion U of the powder component 15 of the PDP 1 according to the first embodiment of the present invention exhibited a higher luminous intensity than the bottom portion Up1 of the powder component of the PDP of the first conventional example.

In accordance with the first embodiment of the present invention, since an annealed layer 15*a* is formed on the exposed surface of each of the powder components 15, it is possible to provide a front panel for a PDP and a method for producing the same, and a PDP provided with the front panel for a PDP, which can suppress the incidence of chipping of the barrier rib 24, can enhance the stability of initial electron emission, and can reduce a voltage required for maintaining a wall charge.

Second Embodiment

Figure 8:
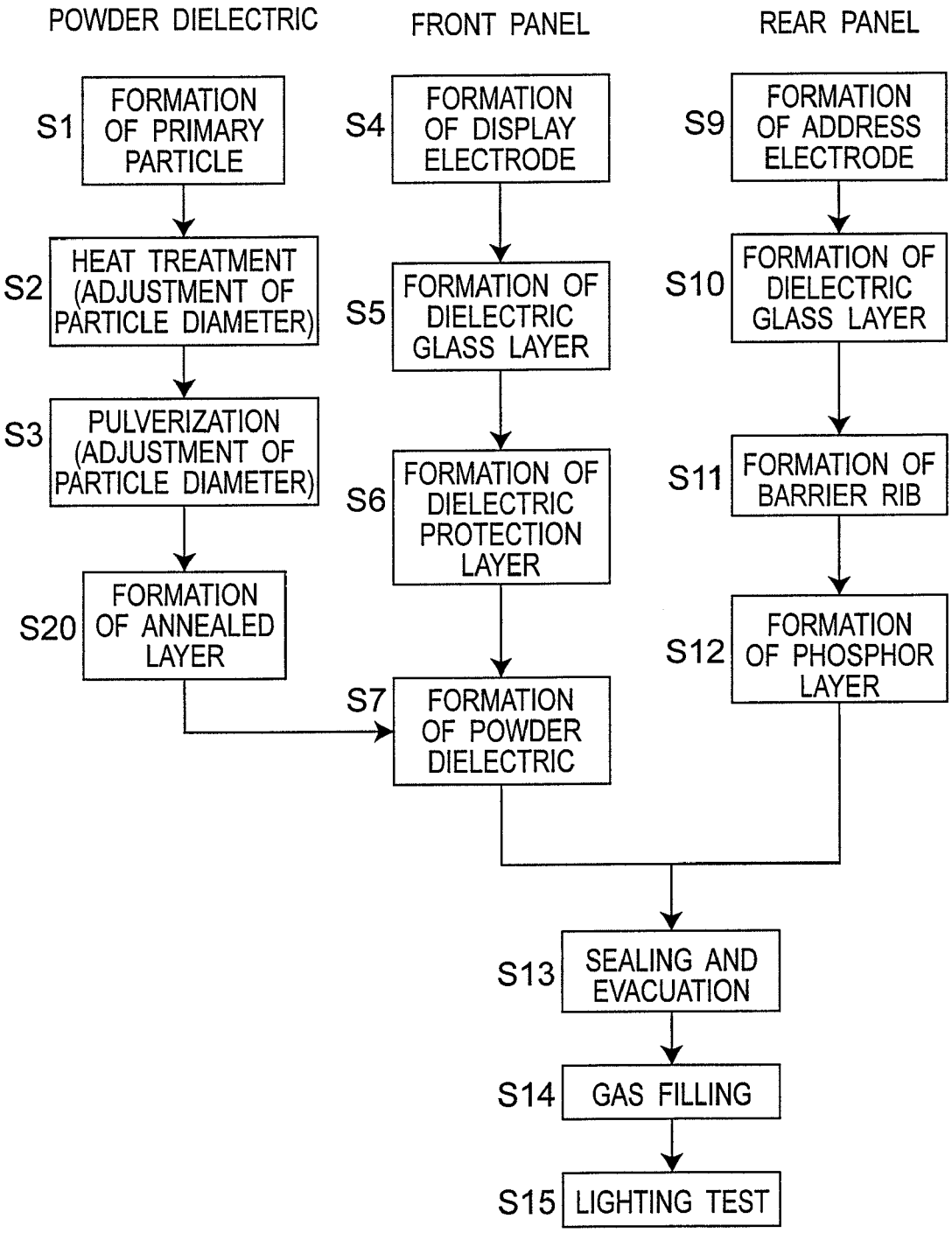
FIG. 8 is a flow chart showing a method for producing a plasma display panel according to a second embodiment of the present invention.
Figure 9:
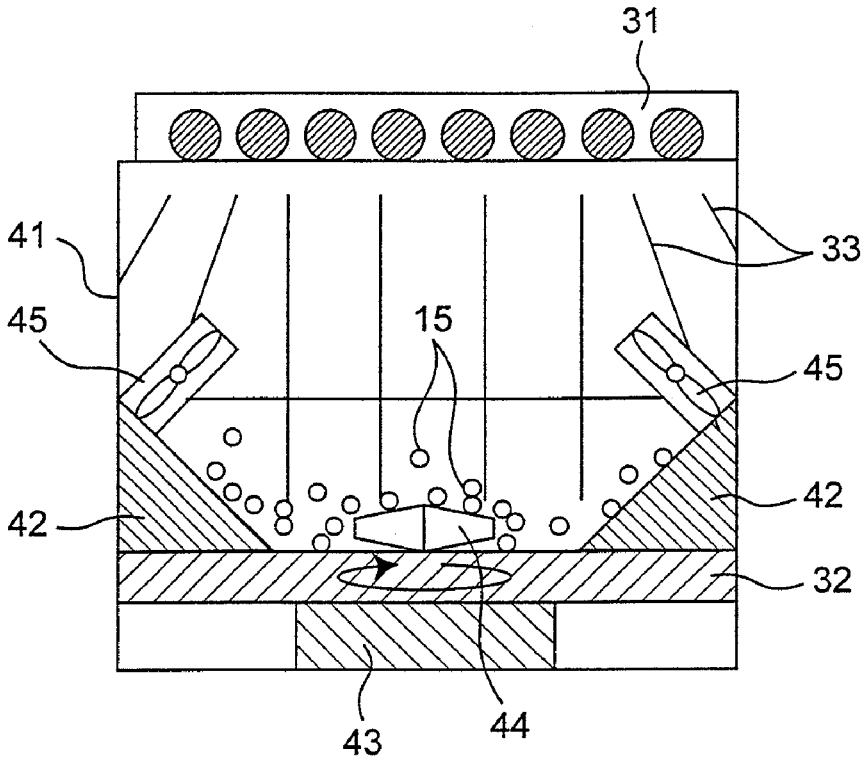
FIG. 9 is a view schematically showing the state of forming an annealed layer on the entire surface of each of powder components of the plasma display panel according to the second embodiment of the present invention.
Figure 1:
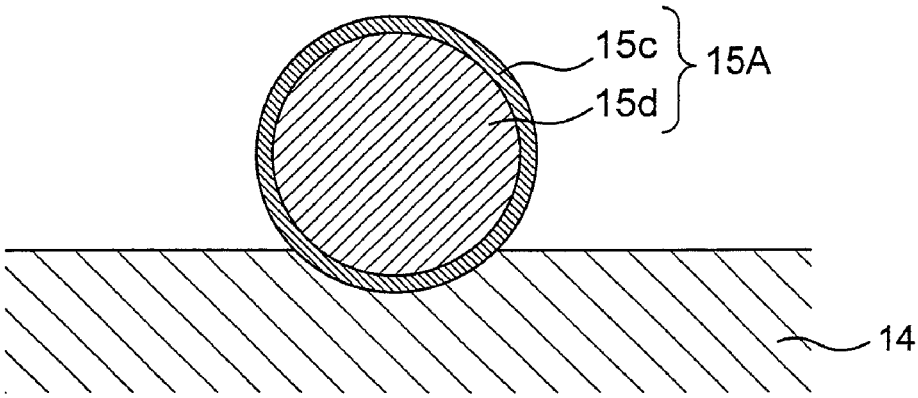

A front panel for a PDP of a second embodiment of the present invention will be described referring to FIGS. 8 to 10. FIG. 8 is a flow chart showing a method for producing a PDP according to the second embodiment of the present invention. FIG. 9 is a view schematically showing the state of forming an annealed layer on an entire surface of each of powder components of the PDP according to the second embodiment of the present invention. FIG. 10 is a partially enlarged sectional view showing a constitution of the powder component of the PDP according to the second embodiment of the present invention.

In the foregoing method of producing the front panel for a PDP of the first embodiment, after the powder components 15 are formed on the dielectric-protection layer 14 (step S7), the annealed layer 15*a* is formed on the exposed surface of each of the powder components 15 (step S8). In the method for producing a front panel for a PDP according to the second embodiment of the present invention, in place of the above procedure, after the annealed layer 15*c* is formed on the entire surface of each of powder components 15A (step S20), the powder components 15A are formed on the dielectric-protection layer 14 (step S7) as shown in FIGS. 8 and 10. Since the method for producing a front panel for a PDP according to the second embodiment of the present invention is similar to that of the first embodiment except for the above-mentioned difference in procedures, an overlapping explanation is omitted. Hereinafter, a method for forming the annealed layer 15*c* on the entire surface of each of the powder components 15A, which is different from the method in the first embodiment, will be described.

Examples of the method for forming the annealed layer 15*c* on the entire surface of each of the powder components 15A include an FLA method in which the xenon lamp 31 is used as with the foregoing first embodiment. An example of the formation method of the annealed layer 15*c*, in which this FLA method is used, will be described referring to FIGS. 9 and 10.

First, the powder components 15A are put in the inside of a substantially tapered metal guide 42 having high thermal conductivity placed in a hermetically-closed container 41.

Next, a heater 32 for a substrate installed in the hermetically-closed container 41 is started, and a magnetic stirrer 43 is operated to rotate a stirrer element 44 while heating the powder components 15A generally to 300 to 500° C., and a fan 45 is rotated to circulate the powder components 15A with air in the hermetically-closed container 41 (refer to FIG. 9).

Meanwhile, pulsed light 33 of the order of ms (millisecond) is irradiated to the powder components 15A about once to ten times with a xenon lamp 31 located above the heater 32 for a substrate. At this time, the pulse width of the pulsed light 33 irradiated is set at about 0.8 to 3.0 ms and its power density is set at, for example, 10 to 40 mJ/cm$^2$.

Thereby, the annealed layer 15*c* can be formed on the almost entire surface of each of the powder components 15A as shown in FIG. 10.

The powder component 15A in which the annealed layer 15*c* is formed on its entire surface as described above is mixed with organic substances so that the concentration of the powder component 15A is generally 0.1 to 20.0% by weight to form a mixed paste, and this mixed paste is applied onto the dielectric-protection layer 14, and then the powder components 15A are dispersed on the dielectric-protection layer 14 by being dried and fired the mixed paste.

Further, as described above, since the depth to which the heat energy reaches in the powder component 15A is generally about several nanometers to 100 nm, the annealed layer 15*c* is formed in a thickness of about 10 to 100 nm on the surface of the powder component 15A.

In addition, when electron beams are irradiated to each of the powder components 15A, the luminous intensity of light by CL emitted from the annealed layer 15*c* of the powder component 15A is higher than the luminous intensity of light by CL emitted from the inner layer 15*b* as with the first embodiment In accordance with the second embodiment of the present invention, since the annealed layer 15*c* is formed on the entire surface of each of the powder components 15A, it is possible to provide a front panel for a PDP and a method for producing the same, and a PDP provided with the front panel for a PDP, which can suppress the incidence of chipping of the barrier rib 24, can enhance the stability of initial electron emission in the dielectric glass layer 13, and can reduce a voltage required for maintaining a wall charge.

Meanwhile, when a dropping test is performed for the front panel for a PDP of the first embodiment and the front panel for a PDP according to the second embodiment, the PDP of the first embodiment is thought to have an advantage that peeling of the powder components 15 from the dielectric-protection layer 14 is less and adhesion is larger.

Next, the estimated reason why the panel characteristics can be improved by forming the annealed layer 15*a* (or 15*c*) on at least the exposed surface of the powder component 15 by the FLA method is described in the following.

First, the estimated reason why the stability of initial electron emission is improved (enhanced) is described.

When the powder components 15 are pulverized to a primary particle level (step S3), a large number of lattice defects such as atomic vacancy and dislocation are introduced in the surface of each of the powder components 15. Since these lattice defects are introduced as various kinds of defects, as a result, energy levels of many different magnitudes (or broad energy levels) are formed in the surface of each of the powder components 15. Electrons are trapped at these various energy levels. Thereafter, if a voltage is applied to the electrons, the electrons are emitted to the discharge space to become a group of initial electrons to sustain discharge inception.

At this time, if the energy levels range widely, the timing, at which the electron is emitted to the discharge spaces, will vary with the time. That is, it is conceivable that the stability of the initial electron emission is reduced (becomes poor).

Accordingly, it is conceivable that by forming the annealed layer 15*a* (i.e., at least the exposed surface of each of powder components 15 is annealed) on the surface of each of the powder components 15, the recovery of lattice defects and recrystallization are prompted and the range of the energy levels is limited, and therefore the stability of the initial electron emission can be enhanced (improved).

Next, the estimated reason why the voltage required for maintaining a wall charge is improved (is reduced) is described.

If the rates of the dielectric-protection layers 14 to be covered with the powder component 15 are equal, the larger the average particle diameter of the powder components 15 is, the larger the total surface area of the powder components 15 becomes. When the total surface area of the powder components 15 becomes larger, the number of electrons charged (trapped) into the powder component 15 is increased, and therefore the voltage required for maintaining a wall charge is increased.

On the other hand, the powder component 15 has a property of being more apt to emit electrons spontaneously than the dielectric-protection layer 14. Accordingly, if the electrons trapped in the dielectric-protection layer 14 become easy to move to the powder components 15, it becomes easier for the electrons to be spontaneously emitted through the powder components 15 to the discharge spaces.

Therefore, it is thought that by reducing the average particle diameter of the powder components 15 to decrease the total surface area of the powder components 15, the number of electrons trapped in the powder components 15 can be reduced and the voltage required for maintaining a wall charge can be reduced.

Further, when a base material of the powder component 15 has a single crystal structure, a grain boundary does not exist, and it is thought that the effect of the energy level generated by the lattice defect on the stability of initial electron emission is large. Therefore, it is thought that when the base material of the powder component 15 has a single crystal structure, an effect of forming the annealed layer 15*a* on the exposed surface of the powder component 15 becomes particularly large.

Further, the present invention is not limited to the foregoing respective embodiments and can be embodied in other various aspects. For example, in the first embodiment of the present invention, the CL method is employed in order to verify the extent of the recovery of lattice defects and recrystallization, however, the present invention is not limited to this. The extent of the recovery of lattice defects and recrystallization may be verified, for example, by a method in which dislocation is observed to determine a dislocation density using a TEM (transmission electron microscope).

Further, in the above description, an average particle diameter of the powder components 15 is set at 2.0 μm, however, the present invention is not limited to this. For example, even if the average particle diameter is set at a particle diameter equal to that of a primary particle of a component composing the powder component 15, a similar effect can be achieved. For example, when the component composing the powder component 15 is magnesium oxide (MgO), an average particle diameter of a primary particle produced by heat-treating magnesium hydroxide (MgOH) is generally 0.2 to 3.0 μm and therefore an average particle diameter of the powder components 15 may be set within this range.

Further, in the above description, magnesium oxide (MgO) has been exemplified as the component composing the dielectric-protection layer 14 and the powder components 15, respectively, however, the present invention is not limited to this and a substance having an excellent electron emission characteristic may be employed. For example, the dielectric-protection layer 14 and the powder components 15, respectively, may include at least one of magnesium oxide (MgO), calcium oxide (CaO), strontium oxide (SrO) and barium oxide (BaO). Thereby, an effect equal to the present invention can be achieved. In addition, an average particle diameter of the powder components 15 may also be set at 0.2 μm or more and 3.0 μm or less as with the case where the powder component 15 is made of magnesium hydroxide (MgOH) also when the powder component 15 is made of calcium oxide (CaO), strontium oxide (SrO), or barium oxide (BaO).

Further, in the above description, the powder components 15 are dispersed on the dielectric-protection layer 14 as shown in FIG. 2, however, the present invention is not limited to this. For example, as shown in FIG. 11, the powder components 15 may be arranged so that the powder component 15 penetrates the dielectric-protection layer 14 and contacts the dielectric glass layer 13. In addition, also in this case, the powder components 15 have to be arranged so that the annealed layer 15*a* or 15*c* is exposed to the discharge space. Thereby, an effect equal to the present invention can be achieved.

Further, in the above description, the annealed layer 15*a* or 15*c* is formed on the powder component 15 by performing flash lamp annealing, however, the present invention is not limited to this. For example, the annealed layer 15*a* or 15*c* may be formed by performing laser annealing (LA), or rapid thermal annealing (RTA).

In accordance with the laser annealing, laser acts thermally on a region at a depth of about several nanometers to 100 nm below the surface of the powder component 15, and the surface of the powder component 15 can be heated to 1000° C. or higher with the assistance of the substrate heater 32 to form the annealed layer 15*a* or 15*c*. The laser annealing has been actually used in reforming polysilicon in a production process of a liquid crystal display. The laser annealing has an advantage that an increase in display area is easy and uniformity is excellent compared with flash lamp annealing. Meanwhile, the flash lamp annealing has an advantage that tact at the time of production is short compared with laser annealing.

In accordance with the rapid thermal annealing, heat acts on a region at a depth of about several tens of nanometers to 300 nm below the surface of the powder component 15, and the surface of the powder component 15 can be heated to 1000° C. or higher with the assistance of the substrate heater 32 to form the annealed layer 15*a* or 15*c*. In the case of the rapid thermal annealing, since heat acts on a region at a depth of about several tens of nanometers to 300 nm below the surface of the powder component 15, the annealed layer 15*a* is formed in a thickness of about several tens of nanometers to 300 nm. The rapid thermal annealing has an advantage that an increase in display area is easier and uniformity is excellent compared with flash lamp annealing and laser annealing. In addition, in the rapid thermal annealing, since the depth to which thermal action reaches is large, the powder component 15 has heat capacity and tends to cause thermal aggregation, and therefore there is a possibility that the average particle diameter becomes large. On the other hand, in the flash lamp annealing, since the depth to which thermal action reaches is small, this annealing has an advantage that such a possibility is inhibited.

It is to be noted that, by properly combining the arbitrary embodiments of the aforementioned various embodiments, the effects possessed by them can be produced. For example, it is possible to employ a method in which after the annealed layer 15*a* is formed in a small thickness (for example, in a half thickness) on the entire surface of each of the powder components 15, the powder components 15 are dispersed on the dielectric-protection layer 14 and thereafter the energy wave is irradiated to the exposed surface of each of the powder components 15 to completely form the annealed layer 15*a*. That is, the annealed layer 15*a* may be formed in two stages before and after dispersing the powder components 15 on the dielectric-protection layer 14.

The front panel for a plasma display panel and the method for producing the same, and the plasma display panel of the present invention are useful particularly for display devices using a plasma display panel since it can suppress the incidence of chipping of the barrier rib of the rear panel for a plasma display panel, can enhance the stability of initial electron emission in the dielectric layer, and can reduce a voltage required for maintaining a wall charge.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The disclosure of Japanese Patent Application No. 2007-137545 filed on May 24, 2007 including specification, drawing and claims are incorporated herein by reference in its entirety.

What is claimed is:

1. A front panel for a plasma display panel comprising:

a substrate, a plurality of electrodes formed on the substrate, a dielectric layer formed to cover the respective electrodes and the substrate, a dielectric-protection layer formed to cover the dielectric layer, and powder components dispersed on the dielectric-protection layer, wherein an annealed layer having a thickness of 10 to 300 nm is formed on at least an exposed surface of each of the powder components, wherein said exposed surface does not contact the dielectric-protection layer.

2. The front panel for a plasma display panel according to claim 1, wherein the annealed layer is a thickness of 10 to 100 nm.

3. The front panel for a plasma display panel according to claim 1, wherein the annealed layer is formed on an entire surface of the powder component.

4. The front panel for a plasma display panel according to claim 1, wherein the powder component emits light by cathode-luminescence having a peak in a wavelength region of 200 to 300 nm by irradiation of an electron beam, and wherein light by cathode-luminescence emitted from the annealed layer has higher luminous intensity than light by cathode-luminescence emitted from an inner layer adjacent to the annealed layer on an inside of the annealed layer.

5. The front panel for a plasma display panel according to claim 1, wherein the powder component emits light by cathode-luminescence having a peak in a wavelength region of 200 to 300 nm by irradiation of an electron beam, and wherein light by cathode-luminescence emitted from a top portion of the powder component has higher luminous intensity than light by cathode-luminescence emitted from a bottom portion of the powder component, wherein said top portion does not contact the dielectric-protection layer and said bottom portion contacts the dielectric-protection layer.

6. The front panel for a plasma display panel according to claim 1, wherein an average particle diameter of the powder components is 3.0 μm or less.

7. The front panel for a plasma display panel according to claim 1, wherein an average particle diameter of the powder components is 0.2 μm or more.

8. The front panel for a plasma display panel according to claim 1, wherein a base material of the powder component has a single crystal structure.

9. The front panel for a plasma display panel according to claim 1, wherein the dielectric layer includes at least one of magnesium oxide, calcium oxide, strontium oxide, and barium oxide.

10. The front panel for a plasma display panel according to claim 1, wherein the powder component includes at least one of magnesium oxide, calcium oxide, strontium oxide, and barium oxide.

11. A plasma display panel having the front panel for a plasma display panel according to claim 1.

12. A method for producing a front panel for a plasma display panel, comprising:

forming a plurality of electrodes on a substrate, forming a dielectric layer to cover the respective electrodes and the substrate, forming a dielectric-protection layer to cover the dielectric layer, and dispersing powder components on the dielectric-protection layer and then irradiating an energy wave to the exposed surface of each of the powder component to form an annealed layer having a thickness of 10 to 300 nm.

13. The method for producing a front panel for a plasma display panel according to claim 12, comprising, in place of dispersing the powder components on the dielectric-protection layer and then forming the annealed layer on the exposed surface of each of the powder components, irradiating an energy wave to an entire surface of each of the powder components to form the annealed layer having a thickness of 10 to 300 nm and then dispersing the powder components on the dielectric-protection layer.

14. The method for producing a front panel for a plasma display panel according to claim 12, wherein annealing of the surface of each of the powder components is performed by any one of flash lamp annealing, laser annealing, and rapid thermal annealing.

* * * * *